United States Patent [19]

Zimmer

[11] 3,953,772

[45] Apr. 27, 1976

[54] CLEANING OF CORONA ELECTRODES

[75] Inventor: Robert E. Zimmer, Niles, Ill.

[73] Assignee: Addressograph Multigraph Corporation, Cleveland, Ohio

[22] Filed: Mar. 25, 1974

[21] Appl. No.: 454,232

[52] U.S. Cl. ..... 317/262 A; 15/1.5 R; 250/324

[51] Int. Cl.[2] ..... H01T 19/00

[58] Field of Search ..... 317/262 A; 55/112; 179/115 VC; 84/9, 258, 321; 250/324–326; 15/1, 1.5, 94

[56] References Cited

UNITED STATES PATENTS

| | | | |
|---|---|---|---|
| 1,339,471 | 5/1920 | Meston | 55/112 |
| 3,496,352 | 2/1970 | Jugle | 15/1.5 |

FOREIGN PATENTS OR APPLICATIONS

| | | | |
|---|---|---|---|
| 535,083 | 9/1931 | Germany | 179/115.5 UC |

OTHER PUBLICATIONS

IBM Technical Disclosure Bulletin, Vol. 14, No. 6, p. 1860, Nov. 1971, "Vibration Suppressor for Corona Wires".

*Primary Examiner*—J. D. Miller
*Assistant Examiner*—Harry E. Moose, Jr.
*Attorney, Agent, or Firm*—Russell L. Root

[57] ABSTRACT

Corona electrodes in electrostatic copying machines take the form of a fine gauge wires, and when subjected to toner an atmosphere with a high density of particle dispersion, can become covered with a deposit which impairs their effectiveness. Cleaning of such a wire is situ without danger of injury thereto is effected by periodically inducing vibrations in the wire, either by controlled mechanical plucking, or by electromagnetically or electrostatically inducing vibrations.

5 Claims, 3 Drawing Figures

CLEANING OF CORONA ELECTRODES

BACKGROUND OF THE INVENTION

This invention relates to corona electrodes operated in an atmosphere which includes a high percentage of particulate toner in suspension. In this situation there is a tendency for the particles to collect on the surface of the electrode and thereby prevent its proper functioning. When the electrode is in the form of a fine gauge wire, problems arise in its handling and cleaning because the wire can be very easily broken. In one form of electrostatic development a finely divided dry electroscopic pigment powder or toner, usually mixed with carrier particles, is brought into contact with the photoconductive surface, where the powder is deposited in a pattern corresponding to the electrostatic image to which it is held by electrostatic attraction.

Improved control and enhancement of the effectiveness of this development step can be brought about by introducing an appropriate electric field or bias at the point where development is taking place, and one efficacious way of bringing this about is to apply an electrostatic charge of the appropriate voltage and sign to the rear surface of the photoconductor as it passes through the development zone. Such treatment customarily employs a corona discharge device whose output element or electrode is a fine gauge wire stretched near the path of the photoconductor.

In this description the term "fine gauge" is intended to identify the corona wires normally used in electrostatic copiers. Because of size, power supply, and human factor restrictions, these coronas are normally operated at close spacing to the work, and at minimum power input and hence the electrode wires are required to be of minimum practical diameter to produce effective ionization. The design limitations relating to machine size dictate the use of wires between 0.002 inches and 0.005 inches in diameter, which, even when made of high strength materials, are necessarily delicate and easily broken. Wires substantially in the foregoing strength range are contemplated whenever the term "fine gauge" is used hereinafter.

One serious difficulty with the use of a fine gauge corona wire at the development location is the fact that, with the unavoidable concentration of toner powder in the air near the development station, a certain amount of powder becomes attracted to and forms a deposit on the surface of the wire. When this happens, the effective diameter of the wire is increased and in consequence it becomes too large to function reliably as a corona electrode, and the quality of the developed copies experiences progressive degradation.

Various attempts have been made to overcome this problem, but probably none have been as effective as merely removing the electrode assembly periodically and wiping the wire clean by hand. This, however, is a rather awkward procedure, and tends to be untidy and to soil the operator's hands with toner powder. More important than that, however, is the problem of the delicate character of the small diameter wire which is easily broken, especially if the cleaning step has been neglected too long and the toner has become caked on the wire so that forceful removal is required.

SUMMARY OF THE INVENTION

According to the present invention, equipment is provided for cleaning the wire in place by mechanical or electrical means and in, the preferred form, at regular intervals without operator intervention. This has been accomplished in one form by providing a plectrum situated on the machine near the wire electrode. Either the electrode assembly or the wire is movably mounted so that they can be brought into contact causing the wire to be plucked and to vibrate. This can be controlled with extreme accuracy so that the force applied to the wire is precisely limited to a desired value and the danger of wire breakage is removed. Moreover, it is a method of cleaning that can be employed without dirt or inconvenience, and which can be performed automatically on a regular basis of prescribed frequency so as to prevent the build-up and caking of toner which makes cleaning difficult and thereby jeopardizes the wire during the more drastic cleaning processes required when this build-up is permitted to go too far. In addition, the wire electrode is kept clean enough at all times to maintain a uniform standard of copy quality.

Alternate electrical means for causing the wire to vibrate in a similar manner are detailed at length below.

DESCRIPTION OF THE PREFERRED EMBODIMENTS

Figure 1:
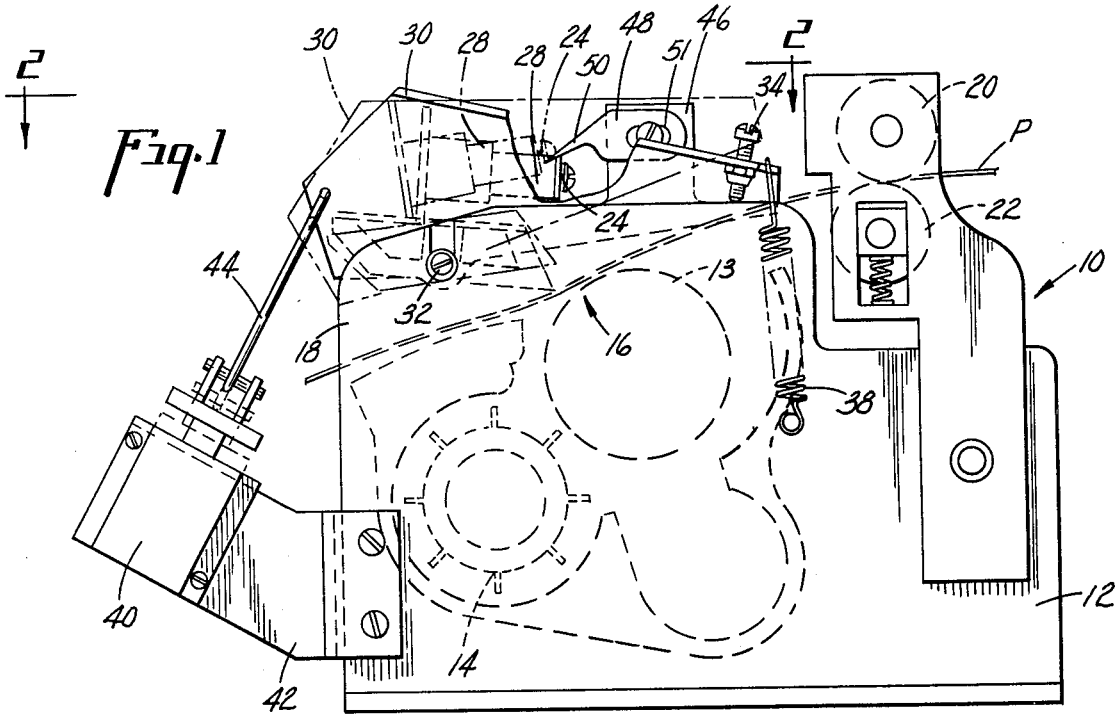
FIG. 1 is a side elevation of an electrostatic development unit with parts broken away, illustrating the electrode cleaning system of the present invention.

Referring to the drawing, a developer unit 10 is illustrated. In this particular instance the unit is shown as a magnetic brush type, although the invention is equally applicable to units of other types as well. The unit includes a housing 12 in which are rotatably mounted a cylinder 13 which houses fixed magnets (not shown) in a known manner.

Developer mix including toner powder and magnetic carrier particles are brought into proximity with the surface of cylinder 13 by a paddle-equipped mixing cylinder 14 and then are magnetically carried in brush configuration on the surface of cylinder 13 past a development station indicated at 16.

A photoconductor sheet P can be introduced into the unit from the left, face down, at the entrance 18 and will be guided through the development station 16 where its latent electrostatic image receives toner particles from the developer mix, and thence to feed rollers 20, 22 which feed the sheet through and on to additional treatment locations.

To enhance the quality of the development, an electrical field is generated at the development station 16 by a corona electrode which deposits a charge of suitable intensity and sign on the reverse or upper surface of the sheet P as it passes by. This electrode is in the form of a fine gauge wire 24 stretched transversely of the path of the sheet P and clamped at each end by a screw 26 threaded into an insulating stand off post 28. Electrical connection is made to the wire 24 from a high voltage power supply 31 via conductor 33, the opposite terminal of the power supply being grounded on the adjacent conductive frame portions via conductor 35.

According to the illustrated arrangement the electrode assembly, including the wire 24 and stand off posts 28, is supported on a subframe 30 which is rockable on frame 12 through a small angle about a pivot means 32. The normal home position of subframe 30 is shown in full lines in FIG. 1, and the displaced position in broken lines.

The position of the wire 24 with respect to the sheet P at the development station can be precisely adjusted by means of stop screw 34 threaded through the subframe at a location where it strikes the main frame, and the subframe is held in normal position with the stop screw 34 in contact with the main frame by a tension spring 38.

As can be seen, rocking the subframe 30 back and forth will move the wire 24 through a small arc between the full line and dotted line positions of FIG. 1. This motion is accomplished by a solenoid 40 mounted on a bracket 42 attached to the frame 12, and connected to the subframe 30 by a link 44.

When the solenoid is energized it draws the subframe 30 and the wire 24 to the dotted line positions (as shown in FIG. 1) against the force of spring 38, and when the solenoid is deenergized, the spring returns the parts to the solid line position which they occupy during normal operation.

Figure 2:
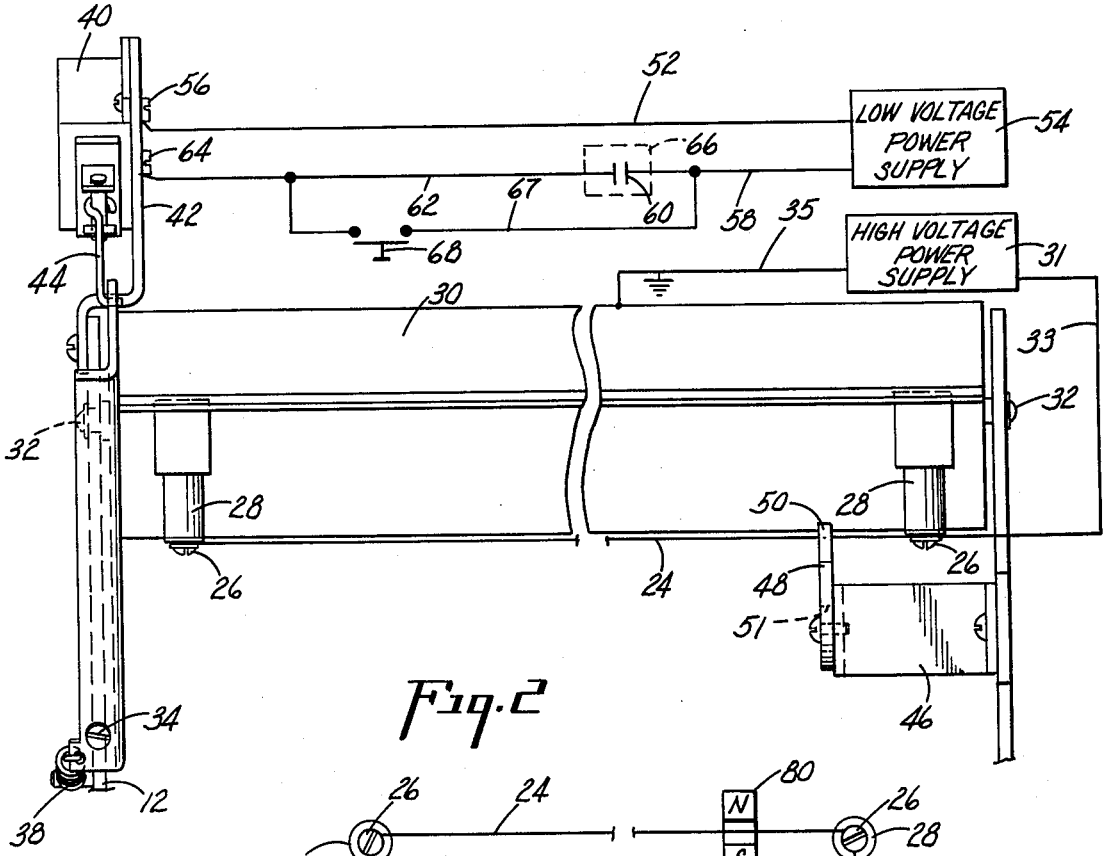
FIG. 2 is a fragmentary plan taken substantially on line 2—2 of FIG. 1; and including features in circuit diagram form.

Mounted on the frame 12 is a bracket 46 which carries a plectrum 48 fashioned of an insulating plastic, such as nylon, and whose projecting point 50 is adjusted to lie in the path of the wire 24 as it swings through the short arc aforementioned. As seen in FIG. 2, the length of the bracket is preferably chosen so as to place the plectrum 48 at a position lengthwise of the wire 24 so that when the wire is plucked by the plectrum 48 it will vibrate as a whole unit mainly at its fundamental frequency and not primarily in segments at a harmonic frequency. As indicated by the slot 51, the plectrum position can be precisely adjusted so that the plucking force exerted will be adequate for cleaning, but not sufficient to endanger the integrity of the wire.

Operation of the cleaning system is as follows. At a time when the developer unit is not in use, the solenoid 40 is energized and then deenergized with the result that the frame 30 is shifted and returned to home position, and the wire 24 thereby caused to be plucked twice by the point 50 of the plectrum 48. With the wire adjusted to the proper tension, which is such that its fundamental will produce a fairly high pitched audible sound, it will vibrate vigorously and thereby remove any toner powder which has accumulated on its surface since the last activation.

The energization of the solenoid may occur by means of any of various alternative arrangements, one of which may be a manually actuated switch controlled by the operator whenever cleaning is thought to be required. It is preferred, however, to have the cleaning operation so controlled that it occurs automatically at suitable intervals and, accordingly, the present invention, in its preferred form, employs an automatic energizing circuit for the solenoid 40. This is diagramatically illustrated in FIG. 2 wherein one lead 52 of a power supply 54 is fastened directly to one connector 56 on the solenoid 40, while the other lead 58 is attached to one contact of a switch 60, the other contact of the switch 60 being connected by a lead 62 with the other terminal 64 of the solenoid. Switch 60 forms part of a conventional relay in a "warm-up" circuit, indicated diagramatrically at 66, and is closed whenever, the machine is turned on after an idle period. This is normally the first thing in the morning, and usually not oftener than two or three times a day otherwise. Thus, whenever the machine is turned on, the warm-up circuit goes into operation and switch 60 is closed, plucking the wire electrode 24 a first time. When the circuit senses the appropriate "warmed-up" condition, it turns off and switch 60 is opened, resulting in a second plucking of the wire electrode 24. It is also feasible to include, if desired, a parallel control circuit including parallel conductor 67 and a manual switch 68, so that the operator may control cleaning upon occasion.

Figure 3:
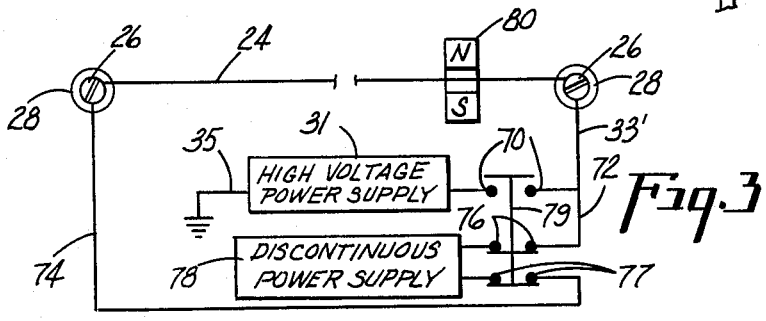
FIG. 3 is a diagram of an alternate cleaning procedure in which the wire is electromagnetically vibrated.

An alternative arrangement for cleaning the wire electrode 24 by vibrating the same is illustrated diagrammetrically in FIG. 3 wherein the parts previously described are represented by the same reference characters as above.

In this case, the high voltage power supply 31 is not permanently connected to the wire electrode 24. Instead, the conductor 35 is replaced by a conductor 33' interrupted by switch contacts 70. A parallel circuit is constructed including conductors 72, 74, switch contacts 76 and 77 and a power supply 78 which develops a discontinuous or alternating output, preferably at a relatively high frequency. A switch member 79 embodies contacts which are mechanically or magnetically interlocked so that when contacts 70 are opened, contacts 76 and 77 are closed and vice versa.

A magnet 80 is placed so that the wire electrode 24 passes between its poles in proximity to their faces, and whenever the contacts 76 and 77 are closed the flow of discontinuous current in the wire sets up rapidly changing force fields which cause the wire to vibrate and thus clean itself by shaking off any attached toner powder. Reversing the contacts 70 and 76, 77 disconnects the discontinuous power source, stopping the vibration, and restores to the now stationary wire, access to the high voltage corona supply.

Another alternative arrangement for cleaning the wire may be put into effect using the circuitry of FIG. 2. In this case the power supply 31 will be understood to have plural outputs at different voltages which can be selectively switched into conducting relationship with conductor 33. It has been found that by adjusting the voltage applied to the corona wire 24 from the normal corona voltage to a higher voltage sufficient to increase the electrostatic forces exerted on the wire by the field existing between the grounded frame and the wire it is possible to cause the wire to vibrate. This is apparently due to the fact that the corona current flow is not strictly level, but pulsates, and thus the electrostatic forces on the wire fluctuate in a similar manner.

This vibration of the wire can be used to shake off the toner deposits as in the previous forms. In one particular arrangement it was found that selectively shifting the voltage impressed upon the wire 24 from the standard corona voltage, say about 5000 volts, to a value just below 10,000 volts, was operative to produce this result. It will be understood, however that these voltages are dependent upon such values as the diameter of the wire, the tension and length of the wire, and the geometry of the system, and can readily be determined for any particular application.

From the foregoing description it can be seen that the invention provides a means for producing a vibratory motion of the wire electrode of the corona generating mechanism so as to cause periodic removal of any accumulated toner powder, and to do so in a manner which can be precisely controlled within a range of force which will not subject the delicate wire to undue stress, thereby greatly extending its life and preventing the need for shutting down the copying machine while waiting for service calls for corona repair. The cleaning does not call for removal of the electrode assembly from the machine and avoids the dirt and nuisance heretofore accompanying this operation.

What is claimed is:

1. A copying machine including means for applying electroscopic toner powder to the surfaces of members having electrostatic images thereon, comprising:

a corona electrode element in the form of a fine gauge, tightly stretched wire for generating a bias in the vicinity of the toner powder application site;

means for energizing said electrode to generate a corona discharge for the aforesaid purpose;

means for stimulating the wire electrode element into a state of controlled vibration of sufficient amplitude to free it of toner powder accumulated on the wire surface without subjecting the fine gauge wire to mechanical effects dangerous to its mechanical integrity, said stimulating means comprising a plectrum element mounted on the machine and coacting with the wire to pluck the same to initiate vibration;

a movable support on said frame for one of said corona electrode element and said plectrum element, so arranged as to provide movement of the one element through a path wherein it conflicts with the other; and means to mechanically actuate said movable support.

2. A copying machine as set forth in claim 1 in which the means to mechanically actuate the movable support comprises a solenoid and operator controlled switch means.

3. A copying machine as set forth in claim 1 in which the machine includes electrical machine function control circuits, and in which the means to mechanically actuate the movable support comprises a solenoid and switch means automatically controlled by the machine function control circuits.

4. A copying machine including means for applying electroscopic toner powder to the surfaces of members having electrostatic images thereon, comprising:

a corona electrode in the form of a fine gauge, tightly stretched wire for generating a bias in the vicinity of the toner powder application site;

means for energizing said electrode to generate a corona discharge for the aforesaid purpose; and means for stimulating the wire electrode into a state of controlled vibration of sufficient amplitude to free it of toner power accumulated on the wire surface without subjecting the fine gauge wire to mechanical effects dangerous to its mechanical integrity, said stimulating means comprising means providing a magnetic field environment for the wire, and means for selectively causing a discontinuous current to flow in the wire.

5. A copying machine including means for applying electroscopic toner powder to the surfaces of members having electrostatic images thereon, comprising:

a corona electrode in the form of a fine gauge, tightly stretched wire for generating a bias in the vicinity of the toner powder application site;

means for energizing said electrode to generate a corona discharge for the aforesaid purpose;

means for stimulating the wire electrode into a state of controlled vibration of sufficient amplitude to free it of toner powder accumulated on the wire surface without subjecting the fine gauge wire to mechanical effects dangerous to its mechanical integrity, said stimulating means comprising voltage augmentation means for said means for energizing the electrode, said augmentation means being capable of raising the voltage to a level significantly above normal corona operating voltage such that the electrostatic forces on the wire cause vibratory movement thereof sufficient to shake deposits thereform.

* * * * *